US006761495B1

(12) United States Patent
Wu

(10) Patent No.: US 6,761,495 B1
(45) Date of Patent: Jul. 13, 2004

(54) PEN STRUCTURE

(76) Inventor: Sheng Hsiung Wu, PO. Box 82-144, Taipei (TW)

( * ) Notice: Subject to any disclaimer, the term of this patent is extended or adjusted under 35 U.S.C. 154(b) by 0 days.

(21) Appl. No.: 10/651,972

(22) Filed: Sep. 2, 2003

(51) Int. Cl.[7] ..... B43K 7/12
(52) U.S. Cl. ..... 401/117; 401/111; 401/112
(58) Field of Search ..... 401/117, 109–112, 401/99, 102

(56) References Cited

U.S. PATENT DOCUMENTS 1,797,016 A * 3/1931 Osborne ..... 401/117
6,530,709 B1 * 3/2003 Washington ..... 401/117

* cited by examiner

*Primary Examiner*—Tuan N. Nguyen
(74) *Attorney, Agent, or Firm*—Leong C. Lei

(57) ABSTRACT

An improved structure of a pen is disclosed. The casing is provided with a conic casing at the top portion and having two protruded pegs. The cap mounting for capping onto the conic casing is provided with an upper circular groove and a lower circular groove at the inner edge of the cap mounting. A vertical sliding rail is provided at the side of the circular groove. The interior of the casing is mounted with a compression spring and a refill and the upper portion of the conic casing is mounted onto the compression spring and is positioned within the cap mounting. The protruded pegs are in combination with the upper circular groove and the lower circular groove so that the rotating of the casing will retracting or extending out the refill for writing.

2 Claims, 7 Drawing Sheets

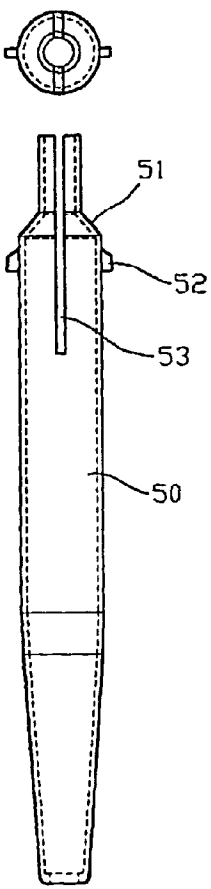
FIG.2F
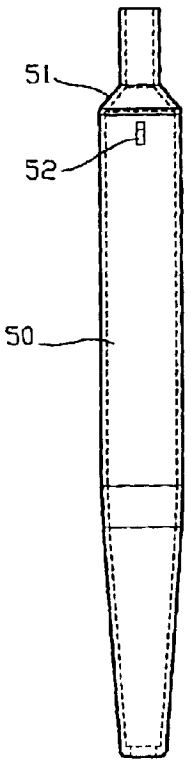
FIG.2E
FIG.2D
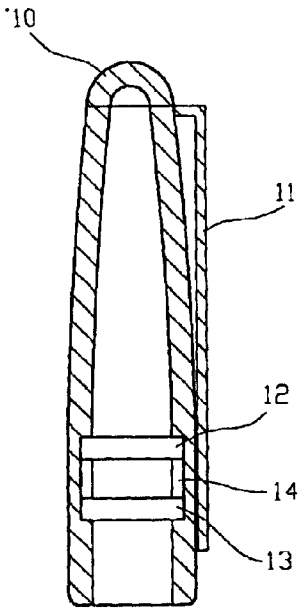
FIG.2B
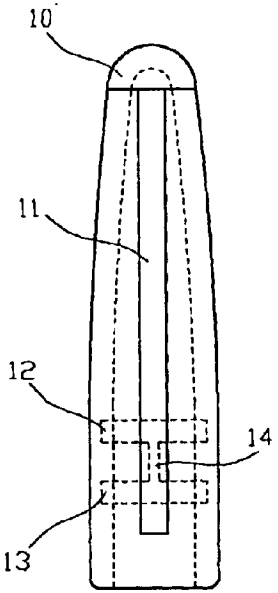
FIG.2A
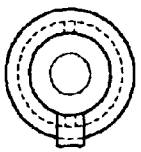
FIG.2C

PEN STRUCTURE

BACKGROUND OF THE INVENTION (a) Technical Field of the Invention

The present invention relates to a pen structure, and in particular, a pen structure having a casing including a conic chasing with the lateral side provided with protruded peg and in combination with a cap mounting having an inner edge provided an upper and a lower circular groove and a vertical sliding rail therebetween. By rotating the casing, a spring causes the protruded peg to-slide into the vertical sliding slot, and a second rotating of the casing causes the protruded peg to engage with the upper end of the engaging peg.

(b) Description of the Prior Art

Generally, pen structure and operation are classified into three categories, (i) a cap mounting mounted onto the writing tip, (ii) rotating the casing to release or retract the refill for writing and pressing a button at one end to release the refill.

With respect to rotating and pressing of button of a pen structure to release refill, generally, the structure includes a refill, a fixing ratchet wheel for rotating connected to the end of the refill, a compression spring for urging, a rotating engaging ratchet wheel, a mounting tube and a press button at the cap. The drawback of these pen structure is that there are too many components and the cost of product is high. Accordingly, it is an object to overcome the above drawback by providing a pen structure comprising a cap mounting, a first and a second compression spring and a conic casing.

SUMMARY OF THE INVENTION

In the present invention, it is provided with an improved structure of a pen comprising a cap mounting, a first and a second compression springs, a refill, and a casing, wherein the casing has an upper conic casing with a lower edge having a protruded peg at the lateral side of the edge, the conic casing is extended downward to form a cylindrical tube provided with appropriate length slot so that the casing is extendable externally and compressible internally, the lower section of the hollow casing has a tapered holding region being mounted with the first compression spring, the refill is positioned within the casing and is urged by the compression spring, the external edge of the conic casing is mounted with the second compression spring for the holding and urging of the cap mounting having a clip, and the inner edge of the cap mounting is provided with an upper circular groove and a lower circular groove for the combination with the two protruded pegs, and a vertical sliding rail is positioned between the two circular grooves, the two protruded pegs at the two lateral sides of the conic casing are in engagement with the lower circular engaging groove; whereby the slidably mounting of the protruded pegs with the upper and lower circular grooves can provide a rapid method of securing the refill while writing or to retract the refill.

Yet still another object of the present invention is to provide an improved structure of a pen, wherein the two protruded pegs and the inner edge of the cap mounting are made into an engaging slot, and an upper circular groove and a lower circular groove, and one side of the groove is a vertical sliding rail.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIGS. 2A–2F illustrate the pen clip structures and the casing of the pen structure in accordance with the present invention.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
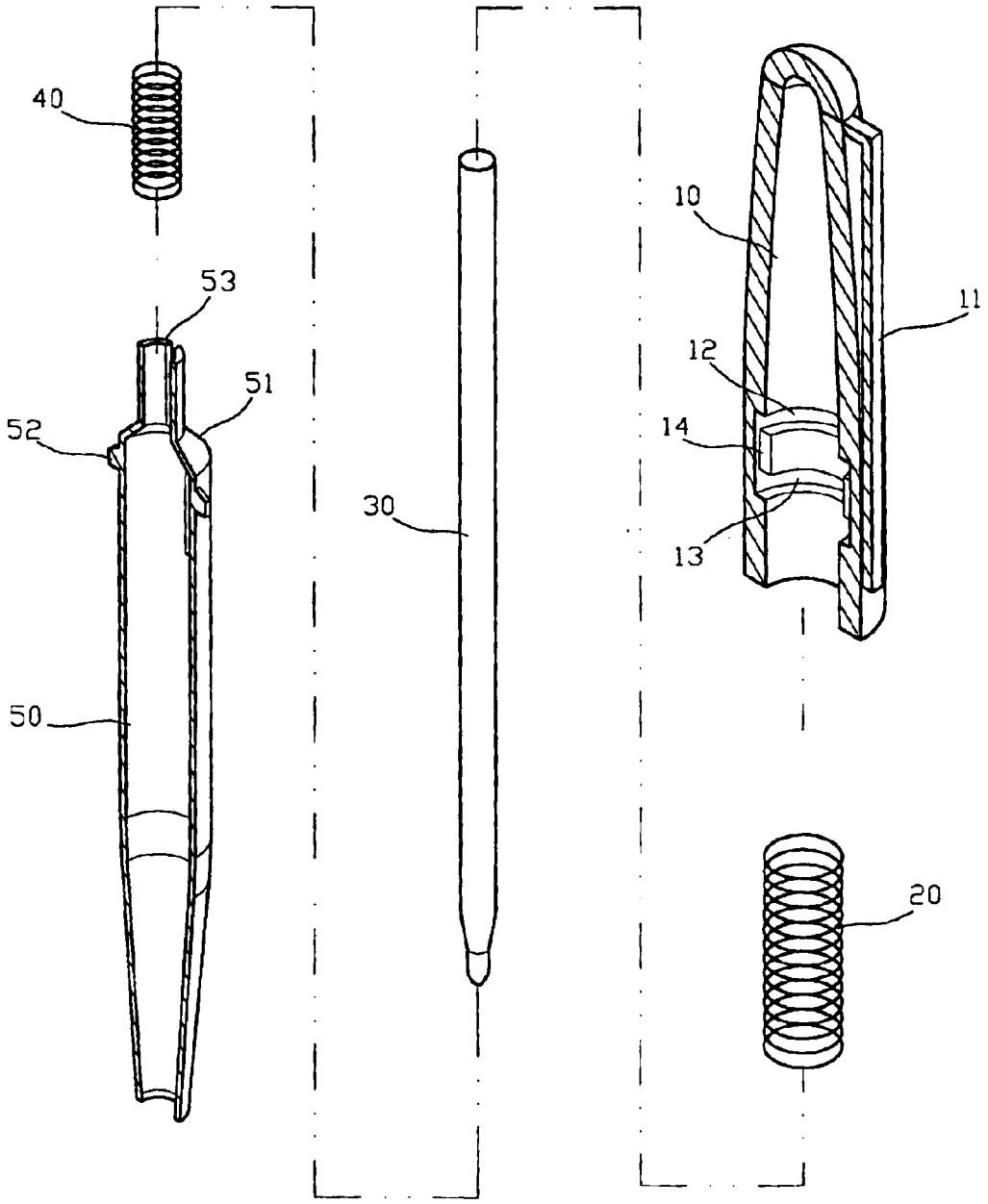
FIG. 1 is a perspective sectional view of a pen structure in accordance with the present invention.
Figure 3:
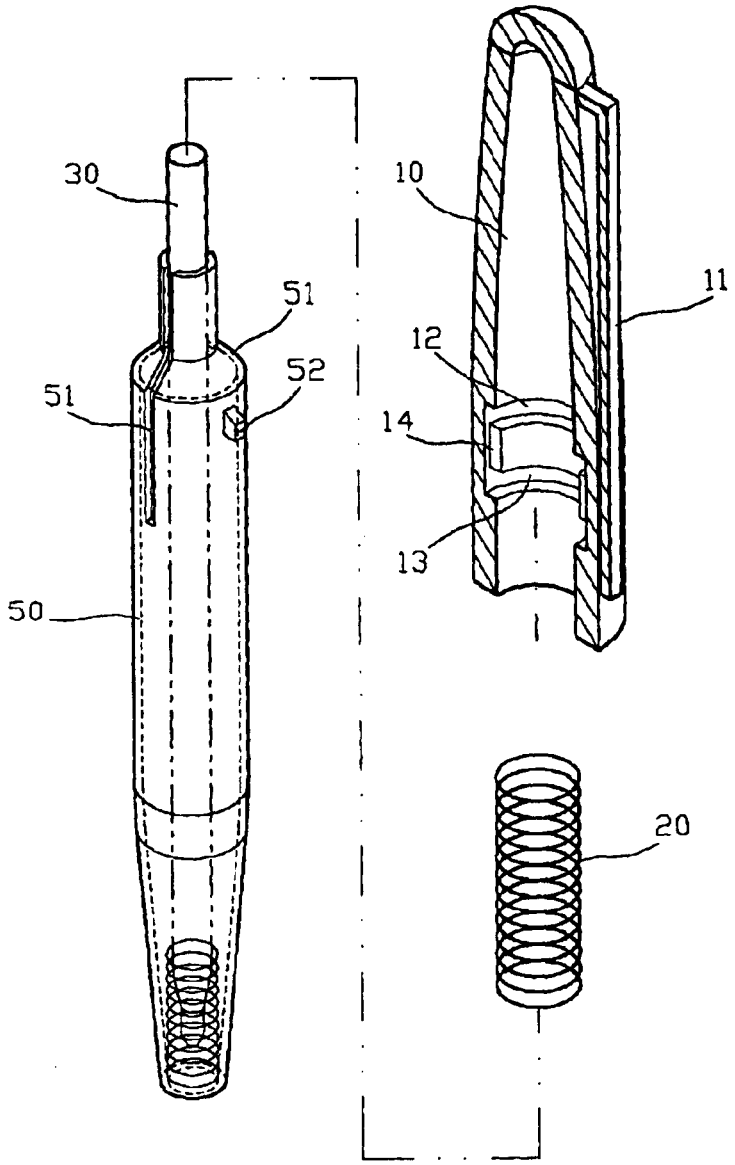
FIG. 3 is a perspective view and partial sectional view of the pen structure in accordance with the present invention.

Referring now to FIGS. 1 to 3, there is shown an improved structure of a pen comprising a cap mounting 10, a first compression spring 20, a second compression spring 40, a refill 30 and a casing 50.

In accordance with the preferred embodiment, the casing 50 has an upper conic casing 51 with a lower edge having a protruded peg 52 at the two lateral sides of the edge. The conic casing 51 is extended downward to form a cylindrical tube provided with a slot 53 of appropriate length. The casing 50 is extendable externally and compressible internally. The lower section of the hollow casing 50 has a tapered holding region being mounted with the second compression spring 40 and a refill is mounted within the casing 50 and is urged with the compression spring 40.

The external edge of the casing 50 is mounted with the second compression spring 40 for the holding and urging of the cap mounting 10 having a clip 11. The inner edge of the cap mounting 10 is provided with an upper circular groove 12 and the lower circular groove 13 for the combination with the two protruded pegs 52. The vertical sliding rail 14 is positioned between the two circular grooves 12, 13. The two protruded pegs at the two lateral sides of the conic casing 51 are in engagement with the lower circular groove 12. This is a position where the pen is not ready to be used for writing.

FIGS. 6A–6E and FIG. 7 show other preferred embodiments of the present invention. The structure is similar to the first preferred embodiment The inner edge of the cap mounting 10 is non-circular but arch shape engaging grooves 12, 13. The end of the upper groove is a protruded engaging slot 15 such that the engaging slots within the cap mounting is diagonally arranged The other side of the engaging slot is cut to form a vertical sliding rail 14 linking to the groove. After the protruded pegs 52 are in engagement with the engaging grooves, the casing is rotated such that the protruded pegs are moved by the vertical slot and the protruded pegs urge the engaging grooves, i.e. reverse rotating such that the protruded peg is in engagement with the engaging slot at the protruded edge. At this instance, the refill 30 is held by the first compression spring 20. Thus, the pen is ready for writing.

Figure 4:
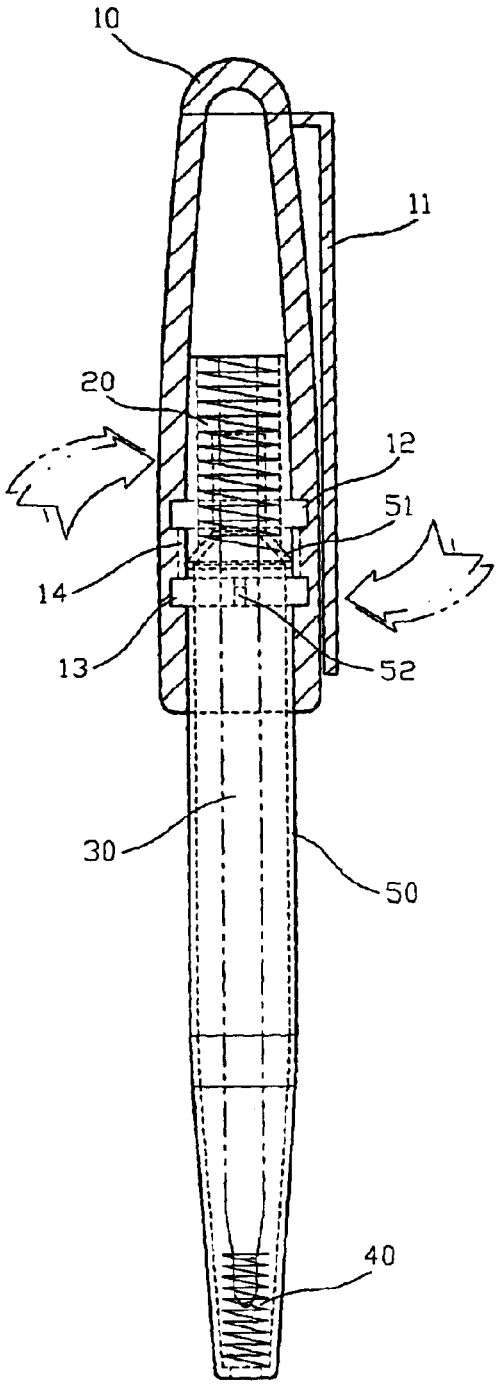
FIG. 4 is a schematic view showing the pen structure of the present invention before rotating to operate the pen.
Figure 5:
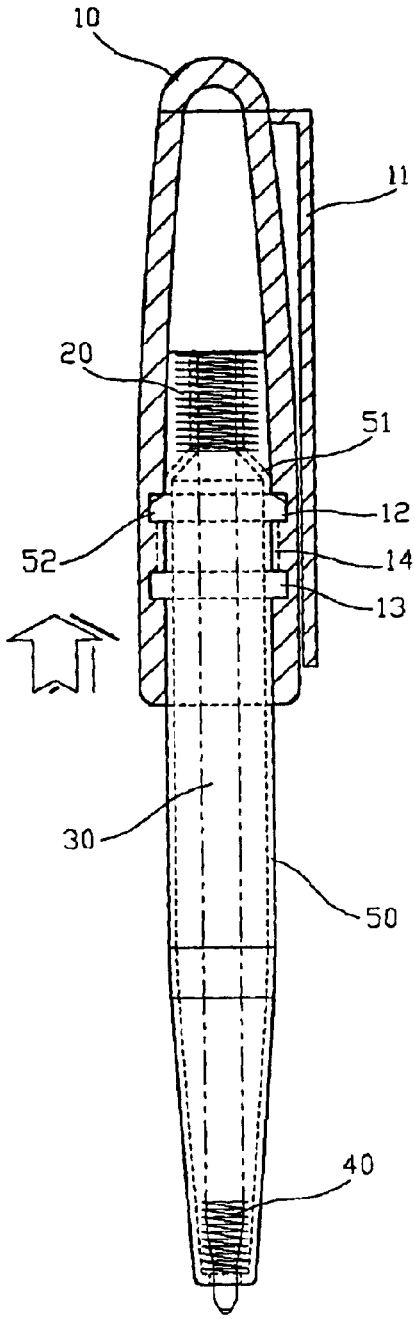
FIG. 5 is a schematic view showing the pen structure of the present invention after rotating to operate the pen.
Figure 6C:
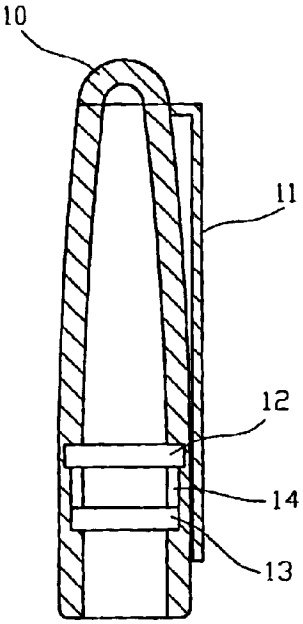
FIGS. 6A–6E are schematic views illustrating other components of the pen structure in accordance with the present invention.
Figure 6E:
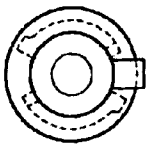
Figure 6B:
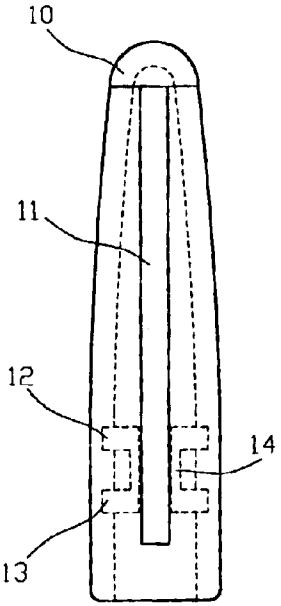
Figure 6D:
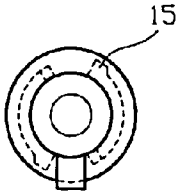
Figure 6A:
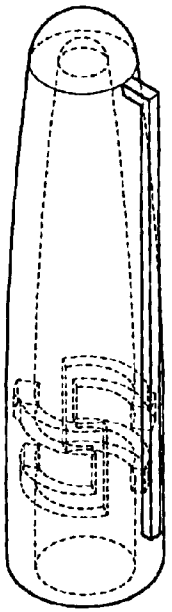
Figure 7:
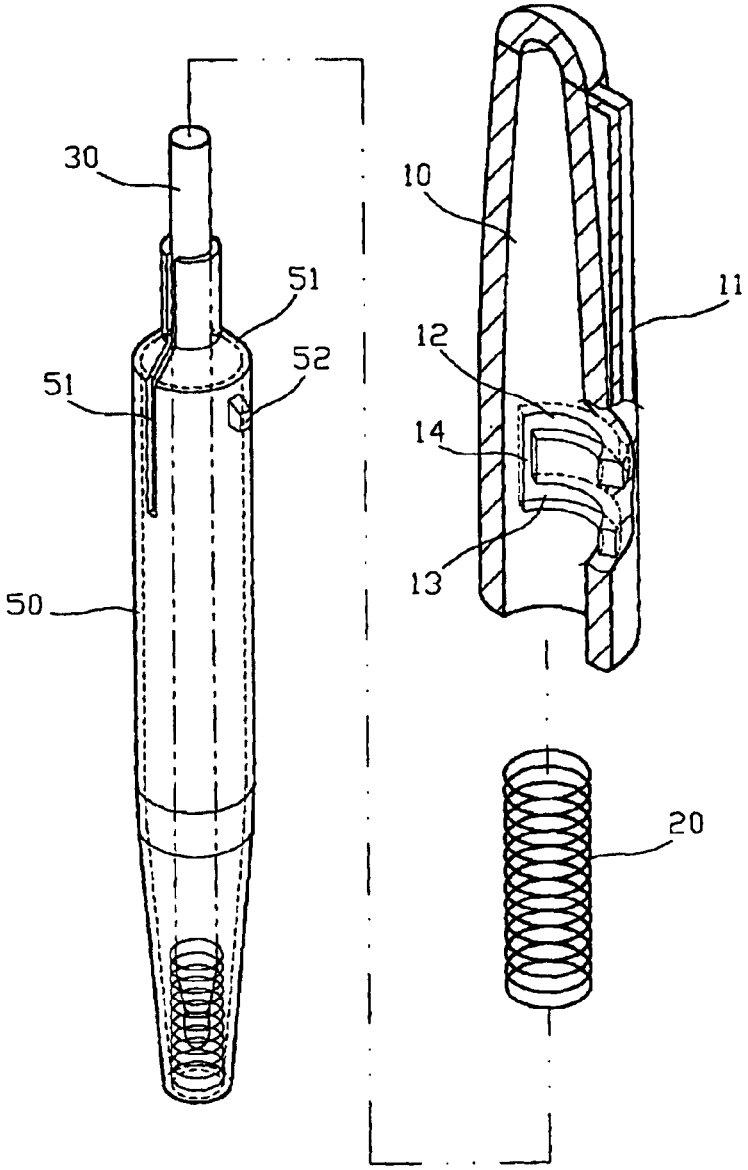
FIG. 7 is a perspective view and partial sectional view of the pen structure in accordance with the present invention.

Referring to FIGS. 4 and 5, there are shown the operations of the pen structure in accordance with the preset invention. As explained earlier, the casing 50 is mounted with a second compression spring 40 and a refill, and the conic casing 51 is mounted with a first compression spring. The protruded pegs 52 are positioned into the engaging groove 13 at the cap mounting 10. At this instance, the compression spring urges the refill and the holding region of the interior of the cap mounting urges another compression spring and the end of the refill. The refill is now at a retracting position. As shown in FIG. 4, this is a schematic view before the pen is in operation and the pen can be carried along without the ink of the refill touches clothing.

The rotating of the casing 50 causes the protruded pegs 52 to rotate and the protruded pegs originally at the lower circular groove 13 are rotated to the vertical sliding rail 14. When the cap mounting 10 is pressed inwardly and the conic casing presses the compression spring 20. When the protruded pegs are pressed to the upper circular groove 12, the casing is rotated to an angle such that the casing is in engagement with the upper circular groove. At this instance, the total length of the refill 30 is longer than the casing, and the refill will be urges by the cap mounting and the tip of the refill will protrude out at the lower end of the casing, as shown in FIG. 5, wherein the pen structure is at ready for writing. In view of the above, the protruded pegs and the upper and lower circular grooves within the cap mounting provide a rapid and convenient of releasing or retracting the refill of the pen.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a pen comprising a cap mounting, a first and a second compression springs, a refill, and a casing, wherein the casing has an upper conic casing with a lower edge having a protruded peg at the lateral side of the edge, the conic casing is extended downward to form a cylindrical tube provided with appropriate length slot so that the casing is extendable externally and compressible internally, the lower section of the hollow casing has a tapered holding region being mounted with the first compression spring, the refill is positioned within the casing and is urged by the compression spring, the external edge of the conic casing is mounted with the second compression spring for the holding and urging of the cap mounting having a clip, and the inner edge of the cap mounting is provided with an upper circular groove and a lower circular groove for the combination with the two protruded pegs, and a vertical sliding rail is positioned between the two circular grooves, the two protruded pegs at the two lateral sides of the conic casing are in engagement with the lower circular engaging groove; whereby the slidably mounting of the protruded pegs with the upper and lower circular grooves can provide a rapid method of securing the refill while writing or to retract the refill.

2. The pen structure of claim 1, wherein the two protruded pegs and the inner edge of the cap mounting are made into an engaging slot, and an upper circular groove and a lower circular groove, and one side of the groove is a vertical sliding rail.

* * * * *